US006478402B1

(12) United States Patent
Greive

(10) Patent No.: US 6,478,402 B1
(45) Date of Patent: Nov. 12, 2002

(54) METHOD AND DEVICE FOR CLEANING A NOZZLE OUTLET SURFACE ON A PRINT HEAD OF AN INK JET PRINTER

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/604,226

(22) Filed: Jun. 27, 2000

(30) Foreign Application Priority Data

Jun. 28, 1999 (DE) ..... 199 29 384

(51) Int. Cl.[7] ..... B41J 2/165
(52) U.S. Cl. ..... 347/30
(58) Field of Search ..... 347/33, 32, 28, 347/29, 30

(56) References Cited

U.S. PATENT DOCUMENTS

| | | | | | |
|---|---|---|---|---|---|
| 4,935,753 | A | * | 6/1990 | Lehmann et al. | 347/36 |
| 4,965,596 | A | * | 10/1990 | Nagoshi et al. | 347/36 |
| 5,455,609 | A | * | 10/1995 | Gast et al. | 347/32 |
| 5,500,660 | A | * | 3/1996 | Childer et al. | 347/33 |
| 5,614,929 | A | * | 3/1997 | Dangelo et al. | 347/30 |
| 5,730,538 | A | | 3/1998 | Kato | |
| 5,790,146 | A | | 8/1998 | Anderson | |
| 6,176,567 | B1 | * | 1/2001 | Uno et al. | 347/55 |

FOREIGN PATENT DOCUMENTS

| | | | |
|---|---|---|---|
| DE | 40 00 454 C2 | | 8/1992 |
| DE | 41 01 695 A1 | | 8/1992 |
| DE | 197 04 003 A1 | | 8/1998 |
| EP | 0 576 175 A2 | | 12/1993 |
| EP | 0 389 481 B1 | | 3/1994 |
| JP | 406087212 | * | 3/1994 |
| JP | 6115083 | * | 4/1994 |
| JP | 406135004 | * | 5/1994 |
| JP | 6262768 | * | 9/1994 |

* cited by examiner

*Primary Examiner*—John Barlow
*Assistant Examiner*—Ly T Tran
(74) *Attorney, Agent, or Firm*—Laurence A. Greenberg; Werner H. Stemer; Ralph E. Locher

(57) ABSTRACT

A method for cleaning a nozzle outlet surface on a print head of an ink jet printer by a cleaning head, the ink being wiped off the nozzle outlet surface by a doctor blade on the cleaning head and being sucked away by a vacuum generator connected to the cleaning head, includes sucking the ink out of the interior of at least one nozzle on the nozzle outlet surface, by forming with the cleaning head an evacuation chamber over the opening, applying vacuum to the evacuation chamber by the vacuum generator, and hermetically sealing off the evacuation chamber; a device for performing the method; an ink jet printer having the device; an offset and/or rotary printing machine integrated with the ink jet printer; and an offset and/or rotary printing machine coupled in-line with the ink jet printer.

13 Claims, 6 Drawing Sheets

METHOD AND DEVICE FOR CLEANING A NOZZLE OUTLET SURFACE ON A PRINT HEAD OF AN INK JET PRINTER

BACKGROUND OF THE INVENTION

Field of the Invention

The invention relates to a method for cleaning a nozzle outlet surface on a print head of an ink jet printer, more specifically, by a cleaning head, the ink being wiped off the nozzle outlet surface by a doctor blade on the cleaning head and being sucked away by a vacuum generator connected to the cleaning head, and also relates to a device for cleaning a nozzle outlet surface on a print head of an ink jet printer by a cleaning head which, more specifically, includes a doctor blade, the cleaning head further having a vacuum generator connected thereto.

A problem which often occurs in ink jet printers is that ink residues and paper dust collect on the nozzle outlet surfaces, so that they have to be wiped off frequently.

For this purpose, a wiping device described in the published German Patent Document DE 40 00 454 C2 can be used. The wiping device described in this published document has only a single doctor blade, referred to therein as an upper lip.

It is possible that the doctor blade, as it sweeps over the nozzle outlet surface, does not pick up all the contaminants and residues which are to be removed. Consequently, the nozzle outlet surface must be wiped off many times with the doctor blade, so that the expenditure of time for the cleaning, and the time during which the ink jet printer is at a standstill, are markedly increased.

A further shortcoming of the wiping device described in the foregoing German document is apparent from the fact that a vacuum pump thereof sucks in a considerable flow of outside air through the suction hole thereof which is open to the surroundings, this flow of outside air not only causing a low efficiency of the device, but also opposing the sucking of the ink out of the interior of the nozzle.

The wiping device has a cleaning head that includes a carrier part connected to the vacuum pump and having the wiping lip inserted therein. In order to clean the nozzle outlet surface, the cleaning head is disposed above the latter. In the case of such an arrangement, no assurance is provided that, after the nozzle outlet surface has been cleaned, no ink will drip back from the cleaning head onto the nozzle outlet surface.

A print head, which is referred to as a printer carriage in the published German document and can be wiped off by the wiping device, is moved relative to the stationary wiping lip, so that the latter brushes or streaks over the nozzle outlet surface on the print head. Although such a construction may indeed be suitable for a lightweight printer carriage having a relatively small-area nozzle outlet surface with only a few nozzles, it is not suitable for a heavier print head. In order to print large printing-material formats at high printing speeds, a print head having a large-area nozzle outlet surface equipped with a relatively large number of nozzles is more suitable. However, such a print head is generally also comparatively heavy and, because of the mass moment of inertia thereof, requires a complex drive mechanism, a high drive power and a large free movement space, in order to be able to move the print head relative to the wiping lip.

The state of the prior art may be further ascertained from the published German Patent Document DE 197 04 003 A1, the published European Patent Document EP 0 389 481 B1 and U.S. Pat. No. 5,730,538.

SUMMARY OF THE INVENTION

It is accordingly an object of the invention to provide a method and a device for cleaning a nozzle outlet surface on a print head of an ink jet printer by which the nozzle outlet surface can be cleaned quickly and thoroughly.

With the foregoing and other objects in view, there is provided, in accordance with one aspect of the invention, a method for cleaning a nozzle outlet surface on a print head of an ink jet printer by a cleaning head, the ink being wiped off the nozzle outlet surface by a doctor blade on the cleaning head and being sucked away by a vacuum generator connected to the cleaning head, which comprises sucking the ink out of the interior of at least one nozzle on the nozzle outlet surface, by forming with the cleaning head an evacuation chamber over the opening, applying vacuum to the evacuation chamber by the vacuum generator, and hermetically sealing off the evacuation chamber.

In accordance with another mode, the method of the invention includes effecting the sealing off of the evacuation chamber by the doctor blade by the engagement thereof with the nozzle outlet surface.

In accordance with a further mode, the method of the invention includes hermetically sealing off the evacuation chamber by an additional doctor blade on the cleaning head by the engagement of the additional doctor blade likewise with the nozzle outlet surface.

In accordance with another aspect of the invention, there is provided a device for cleaning a nozzle outlet surface on a print head of an ink jet printer by a cleaning head formed of a doctor blade and connected to a vacuum generator, the cleaning head comprising at least one additional doctor blade.

In accordance with another feature of the invention, the device includes an evacuation chamber formed between the doctor blades in the cleaning head and being subjectible to suction air and vacuum, respectively, applicable by the vacuum generator.

In accordance with a further feature of the invention, the doctor blades are arranged as seals for sealing off the evacuation chamber between the cleaning head and the nozzle outlet surface.

In accordance with an added feature of the invention, the device includes a motor for moving the cleaning head parallel to the nozzle outlet surface via a first mechanism and/or toward and away from the nozzle outlet surface via a second mechanism.

In accordance with an additional feature of the invention, the first mechanism is a flexible drive mechanism.

In accordance with yet another feature of the invention, the mechanism is a cam control.

In accordance with yet a further feature of the invention, the cleaning head is disposed underneath the nozzle outlet surface.

In accordance with yet an added feature of the invention, the cleaning head is connected to the print head via an ink circuit.

In accordance with yet an additional feature of the invention, the cleaning head has at least three doctor blades.

In accordance with a further aspect of the invention, there is provided an ink jet printer having a device for cleaning a nozzle outlet surface on a print head of the ink jet printer by a cleaning head formed of a doctor blade and connected to a vacuum generator, the cleaning head comprising at least one additional doctor blade.

In accordance with another feature of the invention, the ink jet printer comprises a printing module and a cleaning module, the modules being of compatible construction so that the cleaning module is combinable with the printing module when appropriate.

In accordance with an additional aspect of the invention, there is provided an offset and/or rotary printing machine integrated with the ink jet printer having at least one of the foregoing features.

In accordance with a concomitant aspect of the invention, there is provided an offset and/or rotary printing machine coupled for in-line operation with an ink jet printer having at least one of the foregoing features.

The term "ink" used in connection with the invention comprises both water-based inks and inks of a different composition, for example radiation-curing inks, so-called ultraviolet or UV inks, which can be printed by the ink jet printer.

The ink in the print head sometimes tends to form air bubbles, which collect in the corners within the print head and the nozzles.

An advantage offered by the method according to the invention is that these air inclusions can be removed from the nozzle orifices together with the ink, so that printing faults caused by the air inclusions are avoided. Also, as the nozzle outlet surface is squeegeed or doctored off, paper dust wiped into the nozzle orifice can be sucked reliably out of the nozzle orifice, via the evacuation chamber and the nozzle opening, due to the application of vacuum to the nozzle orifice.

Because the evacuation chamber formed by the cleaning head together with the nozzle outlet surface is sealed off hermetically, the action of sucking outside air into the latter is ruled out or at least restricted to such an extent that it does not impair the function thereof. In order to seal off the gap between the cleaning head and the nozzle outlet surface hermetically, the cleaning head can have a single or multipartite seal. The seal pressed by the cleaning head onto the nozzle outlet surface can slide along on the latter and, consequently from time to time, surround the opening or openings in the nozzle or nozzles, respectively, to which suction is to be applied, as a result of which the vacuum in the evacuation chamber, which is open toward the nozzle outlet surface or, in other words, is closed by the nozzle outlet surface, also becomes effective in the nozzle orifice or the nozzle orifices, respectively. The seal is preferably composed of an abrasion-resistant and resilient material, for example of rubber, polyurethane or other polymer. The seal is preferably formed by the doctor blade or a number of doctor blades on the cleaning head. For this purpose, the doctor blade or doctor blades can be composed of one of the aforementioned materials and constructed as resilient wiping lips.

An advantage provided by the device according to the invention is that as the nozzle outlet surface is wiped off, soil or contaminants which are not picked up by the first doctor blade initially sweeping over the nozzle outlet surface are picked up by the second doctor blade, which sweeps over the nozzle outlet surface immediately following the first doctor blade.

The doctor blades can be formed on the cleaning head, both the cleaning head and the doctor blades being constructed as a single component, for example as a single injection-molded part made of polyurethane.

The doctor blades are preferably fitted to the cleaning head and are composed of a different material from that of the cleaning head. This is advantageous from the point of view of a dimensionally stable construction of the cleaning head, which is composed of a hard polymer, for example, and a soft, resilient construction of the doctor blades, which are composed of rubber, for example. The doctor blades can be affixed to the cleaning head so that they can easily be replaced and, for example, can be clamped into the cleaning head. If abrasive wear of the doctor blades should occur, the worn doctor blades can thus easily be detached from the cleaning head, without replacing the complete cleaning head, and replaced by new doctor blades.

In an embodiment of the device which is advantageous with regard to applying vacuum to the nozzle to be cleaned, the vacuum generator terminates or opens between the doctor blades in the cleaning head, the opening forming an evacuation chamber to which vacuum can be applied in the interspace between the doctor blades, which from time to time is aligned with the opening of the nozzle to be cleaned, due to the wiping movement. It is preferable for a suction line, which connects the vacuum generator to the cleaning head, to terminate or open between the two doctor blades.

In an embodiment which is advantageous with regard to cost-effective production, the doctor blades are formed multifunctionally as seals, and seal off the evacuation chamber between the cleaning head and the nozzle outlet surface.

In an embodiment which is advantageous with regard to cleaning a large and heavy print head having a nozzle outlet surface that is provided with many rows of nozzles, the cleaning head can be moved along the nozzle outlet surface via a first mechanism and/or towards and away from the nozzle outlet surface again via a second mechanism. Due to the fact that, in this case, the cleaning head is movable by a motor, it is possible for the print head to remain in position during the cleaning operation. A single electric motor is preferably used both for driving the cleaning head horizontally along the nozzle outlet surface via the first mechanism and also for driving the cleaning head vertically relative to the nozzle outlet surface via the second mechanism.

In an embodiment which is advantageous with regard to driving the cleaning head horizontally and vertically by the same motor, the first mechanism is a mechanism from the group of flexible drive mechanisms. In such a flexible drive mechanism, two non-adjacent elements of the mechanism are coupled via a supple flexible drive member (belt, tape, cord) or multi-link flexible drive member (chain). The transmission of movement from one element in the mechanism to the other element in the mechanism via the flexible drive is performed by friction, by pairing shapes or by fastening the flexible drive member to the elements of the mechanism, which may be pulleys for example. The flexible drive member may be a closed member, i.e., endless, or open. The flexible drive member can be driven so as to revolve continuously in one direction of revolution or preferably reciprocatingly, i.e., alternately in two different directions of motion. It is preferable if two gear wheels form the coupled elements in the mechanism, and a toothed belt meshing with the gear wheels forms the flexible drive member.

In an embodiment which is likewise advantageous with regard to driving the cleaning head both horizontally and vertically by the same motor, the second mechanism is a cam mechanism. It is preferable for the cam or cam control of the planar cam mechanism to be arranged immovably on the device, and the cleaning head to be guided along the cam, in contact with the latter, by the first mechanism. In addition, the cam can be contoured in such a way that it moves or lifts the cleaning head towards the nozzle outlet surface and moves or lowers it away from the nozzle outlet surface. The cam contour thus has the effect of bringing the doctor blades to bear on the nozzle outlet surface from a position located at a distance therefrom, of holding the doctor blades in contact with the nozzle outlet surface from time to time as the doctor blades sweep across the latter, and of again positioning the doctor blades at a distance from the nozzle outlet surface. The cam can be an appropriately contoured guide rail or guide groove, which forces upon the cleaning head a movement component that is at right angles to the nozzle outlet surface. The cleaning head can be constructed as a slide which slides along the cam contour. The cleaning head is preferably formed as a carriage which rolls along the cam contour.

In an embodiment that is advantageous with regard to avoiding ink dripping out of the cleaning head again or seeping onto the nozzle outlet surface, the cleaning head and the doctor blades are arranged underneath the nozzle outlet surface, so that they can move along the latter. This arrangement of the cleaning head is also advantageous with regard to carrying away the ink squeegeed or doctored off the nozzle outlet surface and often heavily soiled or contaminated with paper dust. This ink does not have to be sucked away by the vacuum generator but can flow over the back of one or more of the doctor blades into that part of the cleaning head located under the doctor blades and from this part into a collecting container, under the action of gravity.

In an embodiment which is advantageous with regard to re-using the ink sucked out of the interior of the nozzles for printing, the cleaning head is connected to the print head via a return line system. The return line system can be an ink circuit which is open to the surroundings or is closed. Parts of the return line system are the vacuum generator and the suction line opening in the cleaning head. Although the ink sucked out of the nozzle orifices contains air inclusions which interfere with printing and which disintegrate after the ink has been sucked away, the ink which has been sucked away, by contrast with the ink squeegeed or doctored off the nozzle outlet surface, is barely soiled or contaminated by paper dust or other ink that has been wiped off. It is therefore very expedient, from an ecological and economical point of view, not to dispose of the ink which has been sucked away in the same way as the ink which has been squeegeed or doctored off, but to use it for printing. The advantageous separation of the ink which has been squeegeed or doctored off, from the ink which has been sucked away, is made possible simply by preceding each of the doctor blades, as viewed in the wiping direction, by an outlet or extraction duct leading into the cleaning head. The first doctor blade, as viewed in the direction of movement of the doctor blades, can be preceded by an outlet duct for the ink squeegeed or doctored off, and the second doctor blade can be preceded by the suction line opening between that doctor blade and the first doctor blade as an extraction duct for the re-usable ink.

In an embodiment which is advantageous with regard to the integration of the ink jet printer into an offset and/or rotary printing machine, or coupled in-line operation of the ink jet printer with the printing machine, the ink jet printer is of modular construction and comprises a printing module with the print head, and a cleaning module to which the cleaning head and the mechanisms moving the latter belong. In order to clean the print head, the cleaning module can be assembled with the printing module of the ink jet printer and removed from the printing module again following the cleaning.

For example, the cleaning module can be inserted as required into the ink jet printer and/or the printing machine and, after the cleaning, can be withdrawn again. The ink jet printer and/or the printing machine can have a window formed in the side wall thereof through which the cleaning module can be pushed. It is preferable for the horizontal insertion direction of the cleaning module to be at right angles to the printing-material transport direction of the printing machine and/or to that of the ink jet printer and also at right angles to the direction of motion of the cleaning head along the nozzle outlet surface.

The easily transportable cleaning module of the assemblable ink jet printer, which is of modular construction, is is preferably constructed so as to correspond with the device according to the invention and can also be a cleaning device having a construction differing therefrom, yet being appropriately compatible so that it is assemblable with the remaining ink jet printer for the purpose of cleaning the print head.

The ink jet printer is preferably assigned to an offset printing machine, which can be a rotary printing machine, or to a rotary printing machine, which can be an offset printing machine, for combined operation as the impression or numbering unit thereof. Using the printing machine, sheet printing material already printed in many colors can thus advantageously be printed by the ink jet printer with individualized codes, for example changing bar codes, consecutive numbers or different recipient addresses, as well. For this purpose, the ink jet printer can be integrated into the printing machine, following the last offset printing device in the printing machine as viewed in the printing-material transport direction. For this purpose, however, the ink jet printer can also be coupled to the printing machine via a printing-material transport device which transports the printing material from the printing machine to the ink jet printer. The transport device can be a conveyor belt, for example, whereon printing-material sheets printed in the printing machine are transported to the ink jet printer. The conveyor belt can extend into the ink jet printer, so that the printing-material sheet resting on the conveyor belt can be printed by the print head in the ink jet process.

Other features which are considered as characteristic for the invention are set forth in the appended claims.

Although the invention is illustrated and described herein as embodied in a method and device for cleaning a nozzle outlet surface on a print head of an ink jet printer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
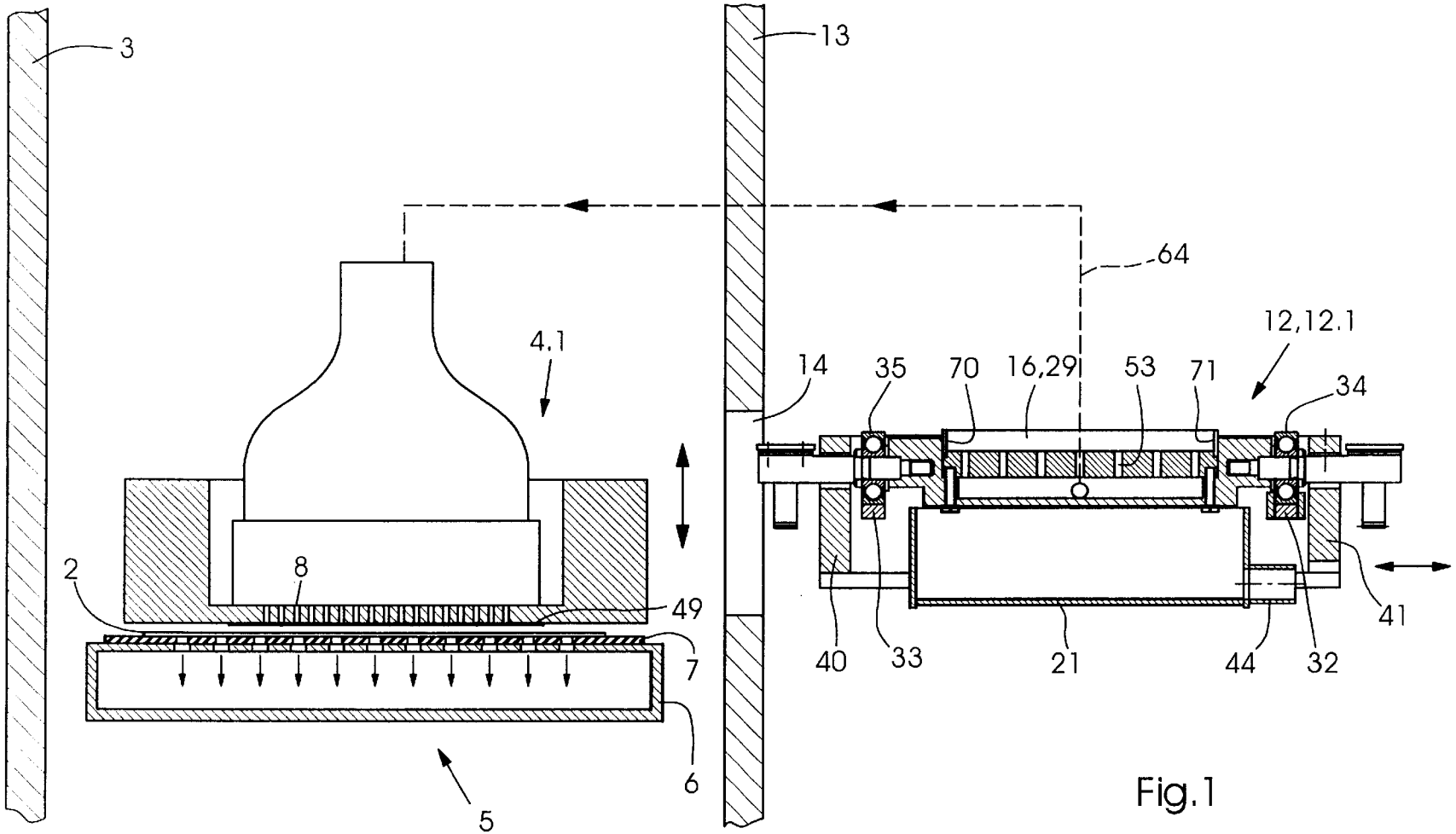
FIG. 1 is a cross-sectional view of an ink jet printer with a cleaning module withdrawn therefrom and with a lowered print head.
Figure 2:
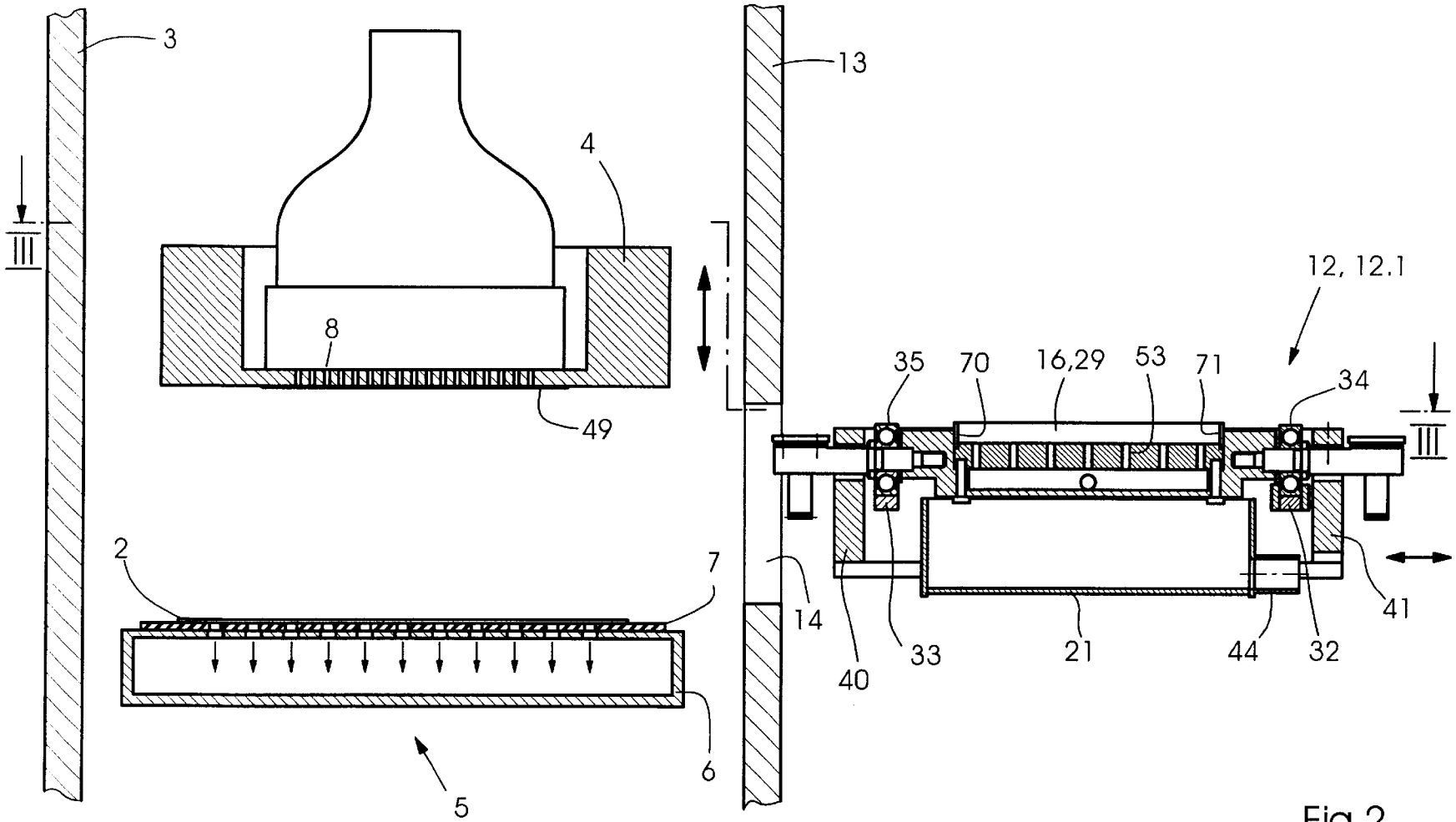
FIG. 2 is a view like that of FIG. 1 of the ink jet printer with the print head lifted.
Figure 3:
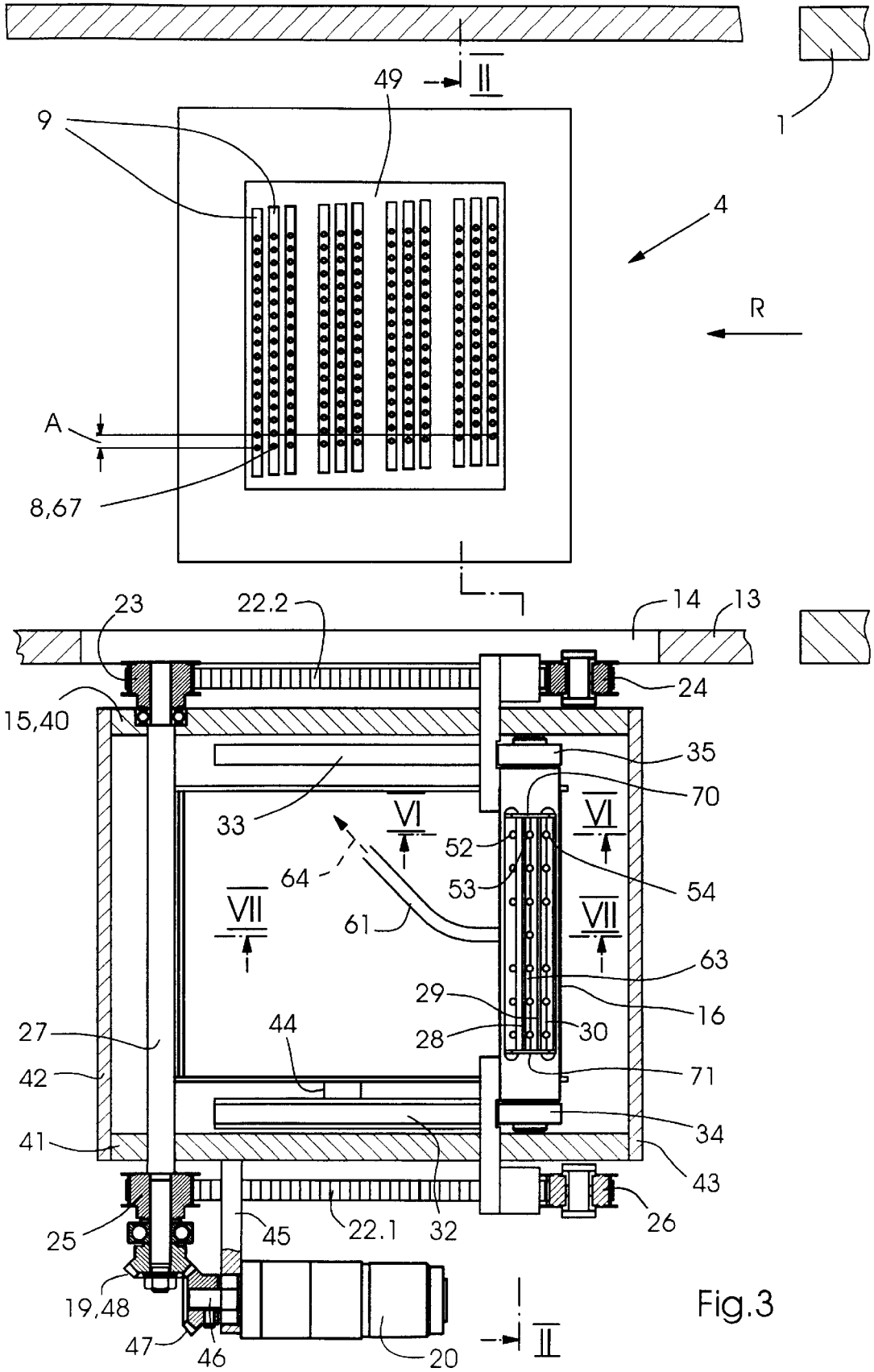
FIG. 3 is a longitudinal sectional view of FIG. 2 taken along the line III—III in the direction of the arrows and rotated clockwise through 90° , and showing the ink jet printer in a plan view.

Referring now to the drawings and, first, particularly to FIGS. 1, 2 and 3 thereof, there is shown therein a printing machine 1, which is constructed as a rotary printing machine for printing sheet printing material 2 in accordance with the offset principle, the printing machine 1 having an ink jet printer 3 disposed downline therefrom as viewed in the printing-material transport direction represented by the arrow R. A print head 4 of the ink jet printer 3 is displaceable, if necessary or desirable, into a printing position 4.1, as shown in FIG. 1, close to the printing material 2 or into a cleaning position 4.2, as shown in FIGS. 2 to 8, withdrawn from the printing material 2. A transport device 5, which is constructed as a suction belt system, serves to transport the printing material from the printing machine 1 to the ink jet printer 3 underneath and past the print head 4. The suction belt system 5 includes a suction table 6 and a circulating conveyor belt 7, which is guided over the suction table 6. The printing material 2 is sucked against the conveyor belt 7 by suction force through openings formed in the conveyor belt 7 and, is consequently firmly held in register on the conveyor belt 7, so that the printing material 2 can be printed on by the print head 4 when it is located underneath the print head 4.

When the print head 4 is located in a printing position 4.1 thereof, wherein it is displaced towards the transport device 5, it is able to print on the printing material 2 in accordance with an ink-jet principle referred to as "drop on demand", nozzles 8 in the print head 4 being activated in accordance with a printing image, so that droplets are ejected from the nozzles 8 only when they are supposed to impinge upon the printing material 2 lying on the conveyor belt 7.

The print head 4 is made up of a number of nozzle modules 9, each of which includes a number of pump chambers, respectively, having a piezoelectric film or foil arranged therein and functioning and activated as a pump or pump actuator. Located at the end of each pump chamber 10 is one of the nozzles 8, from which the ink droplets are ejected. The nozzles 8 of each nozzle module 9 are arranged in a row at a constant distance A from one another. In order to achieve a high resolution, the nozzle modules 9 transverse to the printing-material transport direction R are, respectively, offset by one pixel relative to one another and arranged behind one another in the printing-material transport direction R. The distance A thus corresponds to the product obtained by multiplying the number of nozzle modules 9 by the pixel spacing.

Figure 4:
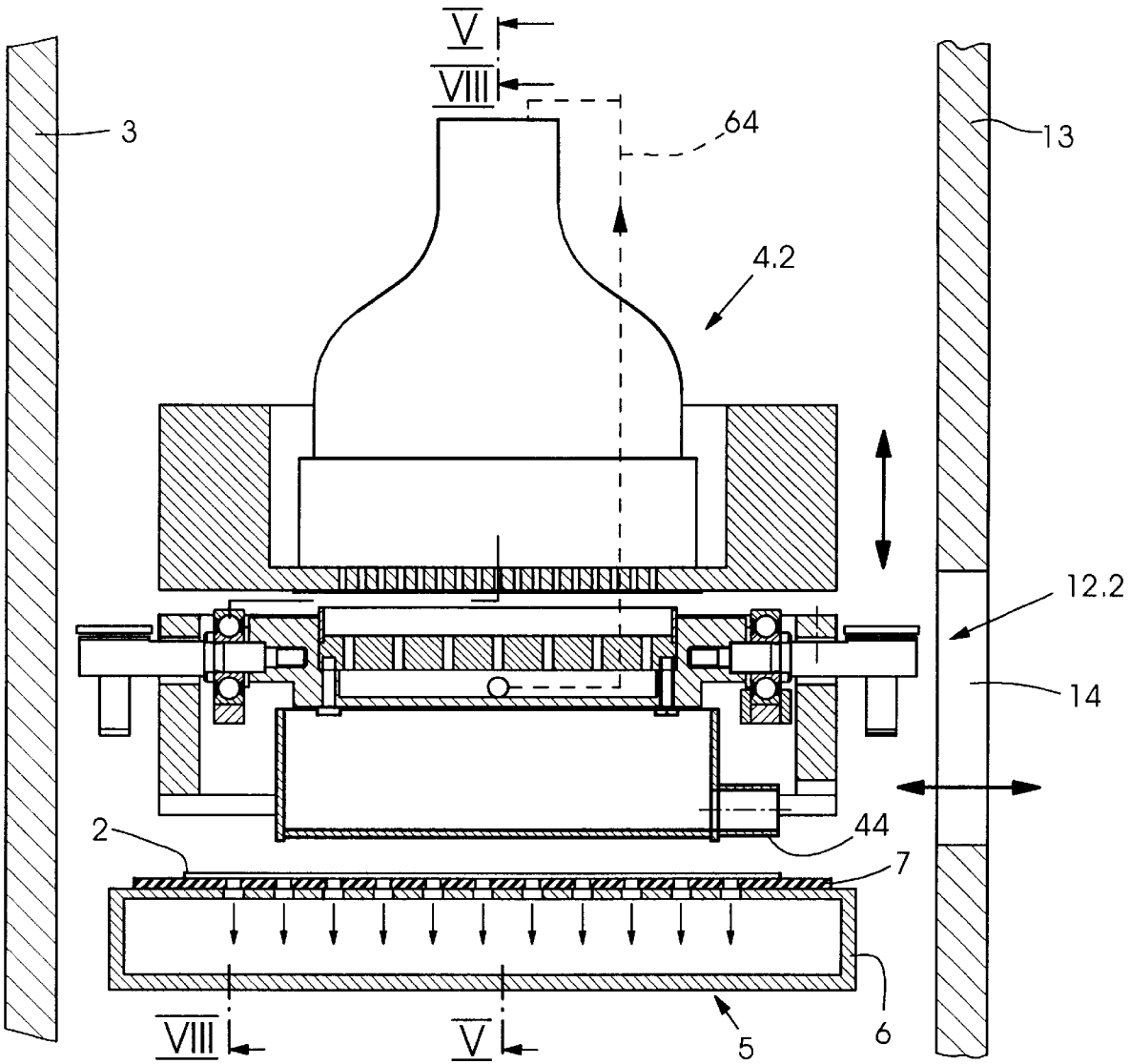
FIG. 4 is a view like that of FIG. 1, slightly enlarged, showing the ink jet printer with the cleaning module inserted therein transversely to the printing-material transport direction.

When the print head 4 is located in the cleaning position 4.2 thereof, a cleaning module 12 is able to be displaced from a passive position 12.1 thereof outside the ink jet printer 3, as shown in FIGS. 1 to 3, into an active position 12.2 thereof within the ink jet printer 3, as shown in FIG. 4. For this purpose, a side wall 13 of the ink jet printer 3 is formed with a window 14 through which the cleaning module 12 is insertable horizontally into the ink jet printer 3, between the print head 4 and the transport device 5.

The cleaning module 12 includes a frame 15, a cleaning head 16, a flexible drive mechanism 17, a cam control 18, a gear mechanism 19, an electric motor 20 and a collecting trough 21. The cleaning head 16 is fixed to at least one flexible pulling member 22.1, 22.2 of the flexible drive mechanism 17, and is moved by a motor 20, via a gear transmission mechanism 19 and the flexible drive mechanism 17, in and counter to the printing-material transport direction R. The cam control 18 (note FIG. 8) moves the cleaning head 16 towards the print head 4, then along and in contact with the print head 4 and thereafter away from the print head 4 again, the path of movement thereof being represented symbolically by the arrow sequence 69 shown in FIG. 5. The flexible pulling members 22.1 and 22.2 of the flexible drive mechanism 17 are toothed belts, respectively wrapping or looping around two pairs of gear wheels 23, 24 and 25, 26, respectively, and meshing therewith.

The yielding flexible pulling members 22.1 and 22.2 advantageously follow the movement forced upon the cleaning head 16 by the cam control 18 towards and away from the print head 4, due to the elastic expandability or tension (belt tension) thereof.

The gear transmission mechanism 19 is a bevel gear mechanism, via which the rotational movement of the motor 20 is transmitted to a drive shaft 27, whereon the gear wheels 23 and 25 are mounted so as to be fixed against rotation relative thereto, so that the flexible pulling members 22.1 and 22.2 are driven in synchronism with one another both in a direction of rotation represented by the curved arrow U1 and in a direction of rotation represented by the curved arrow U2 counter to the direction of rotation represented by the arrow U1. The direction of rotation of the motor 20 is convertible or changeable in order to change the directions of rotation U1 and U2. The direction of rotation U1 corresponds to the operating direction of the cleaning head 16, with contact between doctor blades 28, 29 and 30 thereof and a nozzle outlet surface 31 on the print head 4, and the direction of rotation U2 corresponding to the return direction of the cleaning head 16, preferably with no contact between the doctor blades 28, 29 and 30 thereof and the nozzle outlet surface 31. Returning the cleaning head to the starting position thereof, after sweeping over the nozzle outlet surface 31, can be performed with the cleaning module 12 outside the ink jet printer 3, as shown in FIG. 2.

The nozzle outlet surface 31 is located on the underside of a very thin nozzle plate 49 fixed to the print head 4, nozzle openings having a very small nozzle opening diameter d being formed in the plate 49.

The cam control 18 includes rail-like guide cams 32 and 33, which are fixed to the frame 15 on opposite sides of the cleaning head 16 and to cam rollers 34 and 35 which are rotatably secured to the ends of the cleaning head 16. The rail-like guide cams 32 and 33 are beveled at respective ends thereof, forming a ramp 36 for lifting the cleaning head 16, a linear guide 37 and a ramp 38 for lowering the cleaning head 16 on each of the guide cams 32 and 33.

The guide cam 32 is constructed as a fixed bearing, as viewed in the axial direction of the cam rollers 34 and 35 which are formed as ball bearings, and is provided, for this purpose, with a groove which embraces the cam roller 34 and in which the cam roller 34 runs. From a production technolgy standpoint, it is desirable to construct the guide cam 32 in a three-part sandwich form having a somewhat U-shaped cross section (note FIG. 1).

Figure 5:
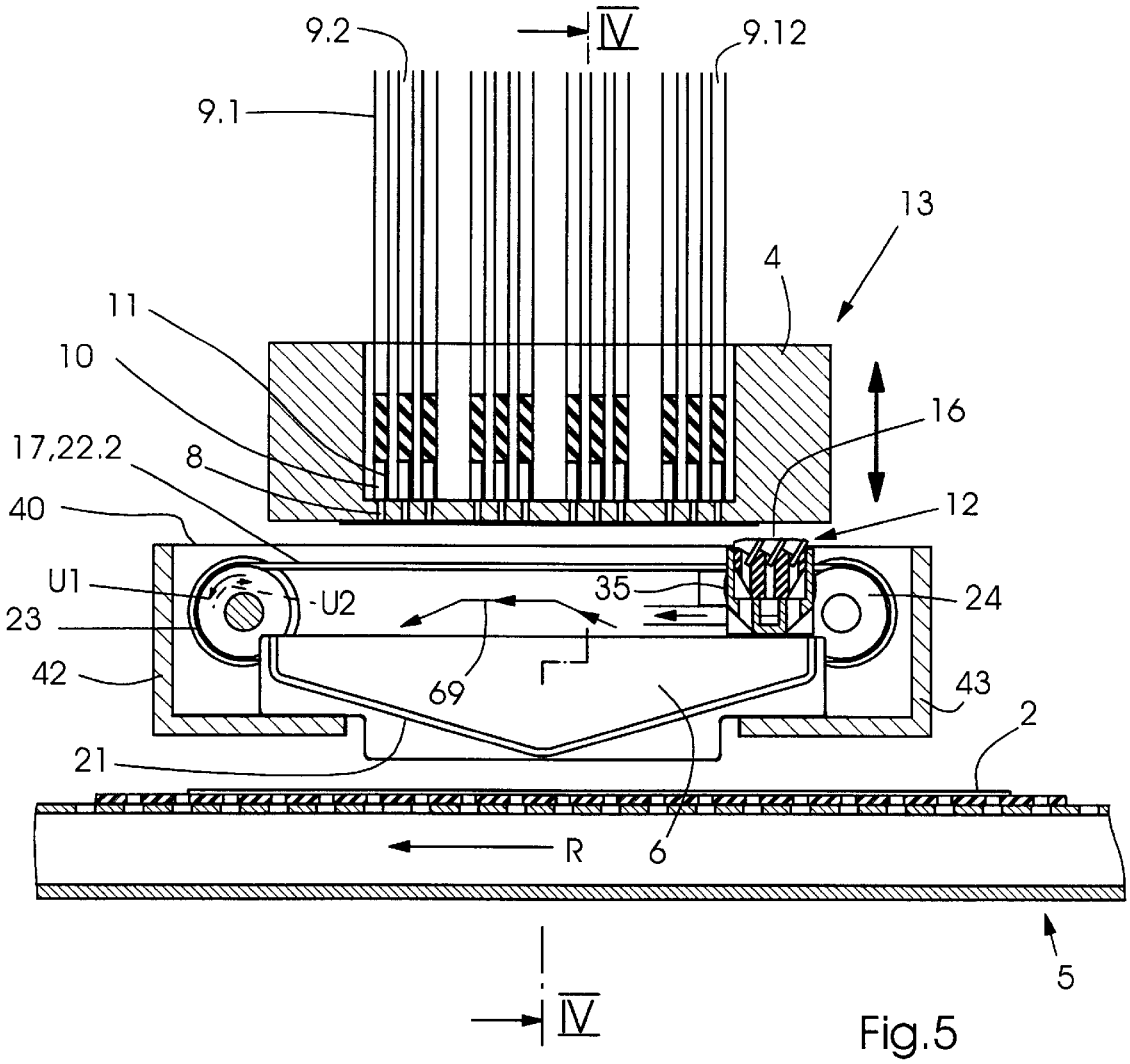
FIG. 5 is a longitudinal sectional view of FIG. 4, taken along the line V—V in the direction of the arrows and showing the ink jet printer and the cleaning module with a cleaning head that is movable in the printing-material transport direction.
Figure 6:
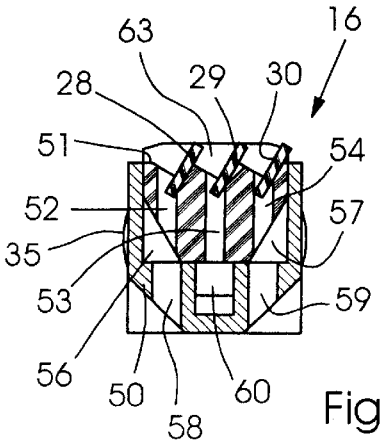
FIG. 6 is an enlarged fragmentary sectional view of FIG. 3 taken along the line VI—VI in the direction of the arrows and showing one aspect of the cleaning head.

The frame 15 includes a side plate 40 and a side plate 41 wherein the drive shaft 27 is rotatably, the side plates 40 and 41 being connected to one another by two crossbeams 42 and 43 having an angular profile (note FIG. 5). The collecting trough 21, which is constructed with a bottom inclined towards an outlet 44 thereof, is fixed to the frame 15, wherein the gear wheels 24 and 26 are also rotatably mounted.

The motor 20 is fixed to the frame 15 on that side of the cleaning module 12 directed towards the window 14 when the cleaning module 12 is in the active position 12.2. Secured to the frame 15 is a bracket 45, which holds the motor 20 so that the motor shaft 46 thereof is at right angles to the drive shaft 27. A bevel gear 47, which is seated on the motor shaft 46 so as to rotate therewith, meshes with a bevel gear 48 that is connected to the drive shaft 27 so that it rotates therewith and belongs to the gear mechanism 19. The beam or bar-like cleaning head and the doctor blades 28, 29 and 30, which are arranged in staggered formation parallel to one another both in the longitudinal direction thereof (note FIG. 3) and in the cross-sectional plane thereof (note FIGS. 6 and 7) extend over the entire length of the rows of nozzles of the nozzle module 9 and are preferably somewhat shorter than the length of the nozzle modules 9 and the width of the nozzle plate 49.

The cleaning head 16 includes a first bar 50 having a somewhat U-shaped profile, in the groove of which an approximately V-shaped profiled second bar 51 is received, tightly sealing off the groove, and being, for example, clamped therein. The dimensionally stable first bar 50 is formed of metal, and the second bar 51 is formed of synthetic material, as a result of which the comparatively complex cross-sectional shape of the second bar 51 can be produced cost-effectively by being shaped without removal of material, for example, by using an injection-molding process. The doctor blades 28, 29 and 30 are firmly clamped in slots formed in the second bar 51, utilizing the resilient material properties thereof.

Figure 7:
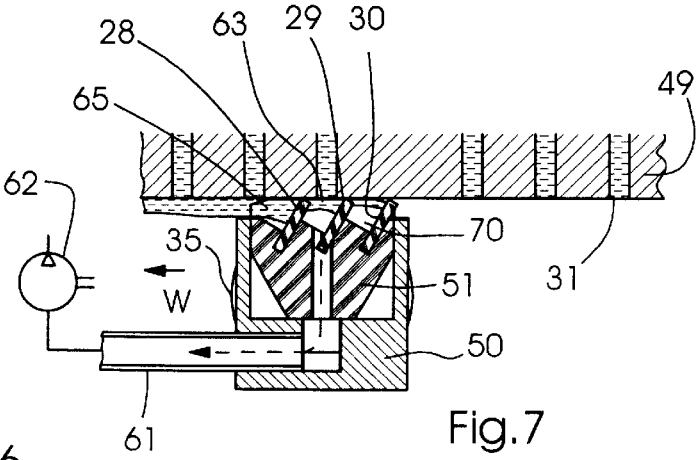
FIG. 7 is an enlarged fragmentary sectional view of FIG. 3 taken along the line VII—VII in the direction of the arrows and showing another aspect of the cleaning head.
Figure 8:
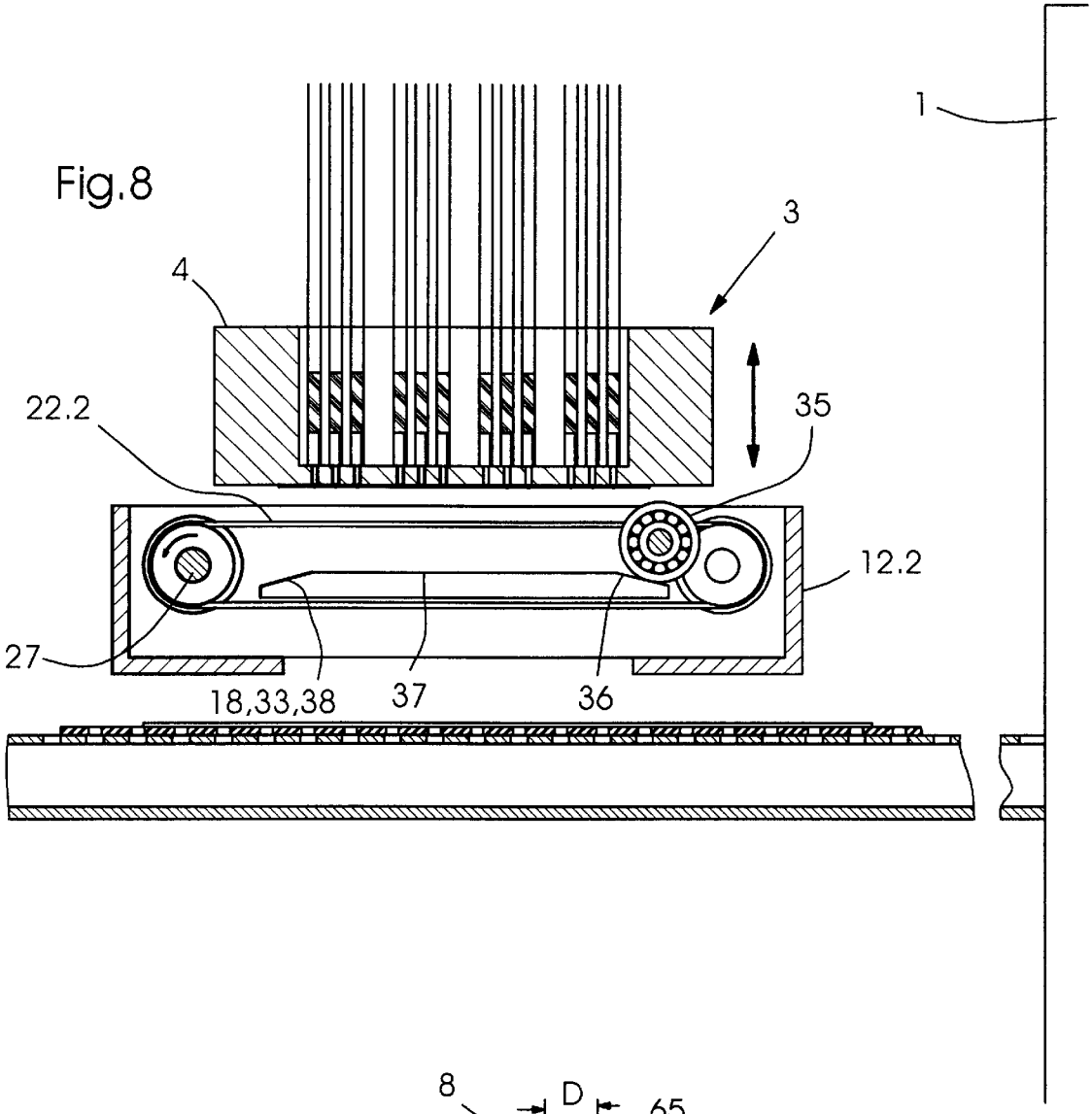
FIG. 8 is a sectional view of FIG. 4 taken along the line VIII—VIII in the direction of the arrows and showing the ink jet printer and the cleaning module with the cleaning head.

As viewed in the wiping direction represented by the arrow W in FIG. 7, the first doctor blade 28 is preceded by at least one aperture 52 and preferably a row having apertures 52, the second doctor blade 29 is preceded by at least one aperture 53 and preferably a row thereof, and the third doctor blade 30 is preceded by at least one aperture 54 and preferably a row thereof. The apertures 52 open into a transverse duct 56, and the apertures 54 into a transverse duct 57, the transverse ducts 56 and 57 being formed by chamfered corners of the second bar 51. The ink that is squeegeed or doctored off, flows under the action of gravity from the doctor blade 28, over the back thereof, through the apertures 52, into the transverse duct 56 and out of the latter, via at least one aperture 58 formed in the first bar 50, into the collecting trough 21. The apertures 58 preferably form a row of apertures 58 corresponding to the apertures 52. The diameter of the apertures 58 is somewhat greater than that of the apertures 52 which are aligned therewith.

From the doctor blade 30, the squeegeed or doctored-off ink also runs, via the at least one aperture 54, into the at least one aperture 59, from which it drips off into the collecting trough 21. It is preferable for the apertures 54 and 59, and the transverse duct 57 into which the apertures 54 and 59 open to be formed suitably as mirror images of the apertures 52 and 58 and the transverse duct 56.

Each aperture 53 opens into a transverse duct 60, which is formed as a narrow groove in the bottom of the broad groove formed in the first bar 50, which accommodates the second bar 51. The width of the small groove forming the transverse duct 60 is greater than the diameter of the apertures 53, however.

Via a hose 61 which is inserted laterally into the first bar 50 and opens into the transverse duct 60, the apertures 53 and the transverse duct 60 are connected to a pneumatic vacuum generator 62, so that an evacuation chamber 63, which is located between the doctor blades 28 and 29 when the doctor blades 28 and 29 are in engagement with the nozzle outlet surface 31, can be subjected to vacuum applied by the vacuum generator 62. While the greatly soiled ink that is squeegeed or doctored off can be disposed of from the collecting trough 21 via the outlet 44, it is possible for the ink sucked out via the evacuation chamber 63 to be fed to the print head 4 again via a suitable ink circuit represented by a broken line 64 in FIGS. 1 and 4.

The motor-driven vacuum generator 62, which is connected to the cleaning head 16 via the flexible hose 61, can be disposed on the cleaning module 12 and can also be disposed on the ink jet printer 3. In the last-mentioned case, the connection between the cleaning head 16 and the vacuum generator 62 can be broken, when the cleaning module 12 is being removed from the ink jet printer 3, for example by pulling the hose 61 off a connecting piece on the vacuum generator 62.

In order to seal off laterally the interspace between the doctor blades 28 and 29, and thus to seal off the evacuation chamber 63, resilient seals 70 and 71 are provided at the ends, the seals 70 and 71 being formed of the same aforementioned materials as those of the doctor blades 28, 29 and 30, and may also be formed of rubber, for example. The doctor blades 28, 29 and 30 are arranged between the seals 70 and 71 which cover the respective doctor blades on the outside and which bear like cheeks tightly against the doctor blades 28, 29 and 30. The seals 70 and 71 fixed to the cleaning head 16 project at least as far out as the doctor blades 28, 29 and 30, so that the seals 70 and 71 are likewise pressed against the nozzle outlet surface 31 as the latter is being squeegeed or doctored off. Thus, each nozzle 8 or row of nozzles to which suction is to be applied and, for this purpose, is covered by the evacuation chamber 63, is enclosed all around by the doctor blades 28 and 29 together with the seals 70 and 71, so that no outside air, or only a little thereof, can be sucked out of the surroundings into the space formed between the doctor blades 28 and 29 and seals 70 and 71.

In embodiments which are not specifically illustrated, it is possible to dispense with the separate seals 70 and 71, because they are molded with the doctor blades 28 and 29 as one structural unit, or the doctor blades 28 and 29 are curved and are, respectively, led together at the two ends thereof.

Figure 9:
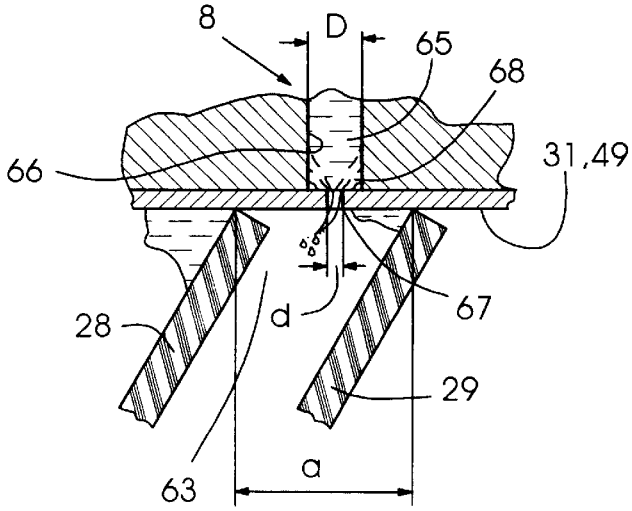
FIG. 9 is an enlarged fragmentary view of FIG. 5 showing a nozzle of the print head diagrammatically.

FIG. 9 shows that the ink 65 is sucked directly out of the nozzle orifices 66 in the nozzles 8 via the evacuation chamber 63. The nozzle orifice diameter D of each nozzle orifice 66 formed in the print head 4 is, for example, 500 $\mu$m and is therefore much larger than the nozzle opening diameter d of each nozzle opening 67 formed in the nozzle plate 49, which can be 20 $\mu$m, for example. With the nozzle openings 67 thereof, the nozzle plate 49 thus partially closes the nozzle orifices 66 in the manner of an aperture stop.

It has been found that a small air bubble 68 can form in the corners between the nozzle plate 49 and the nozzle orifice 66 and can lead to a disruption of the printing and cannot be removed by spraying the nozzles 8 clear, for example as proposed in the published European Patent Document EP 0 389 481 B1. The cause thereof has been recognized that, due to the application of a positive pressure to the nozzle orifice 66, which is required in order to spray it clear, the small air bubble 68 is compressed and forced into the corner, is not detached from the corner and leads to the disruption of the printing. In the case of applying vacuum to the nozzle orifice 66 according to the invention, the small air bubbles 68 expand, as is indicated by broken lines in FIG. 9. The small air bubbles 68 cannot collect in the corners and are instead drawn in the direction of the nozzle opening 67 and through the latter, as a result of which ink 65 can then flow into the corners.

The sucking out the nozzle orifices 66 is performed nozzle row by nozzle row. Because of the movement of the cleaning head 16 in the wiping direction W, the evacuation chamber 63 is aligned with the various rows of nozzles after one another. The spacing a of the doctor blades 28 and 29 is preferably selected so that during the squeegeeing or doctoring-off action, there is, respectively, only a single nozzle module 9 or a single row of nozzles belonging to the latter between the doctor blades.

While the ink 65 is being sucked out, the doctor blades 28, 29 and 30 wipe off the nozzle outlet surface 31, the doctor blade 28 wiping away the ink which has gotten onto the nozzle outlet surface 31 as a result of the printing action, the doctor blade 29 wiping away the ink which has got onto the nozzle outlet surface 31 as a result of being sucked out, and the doctor blade 30 wiping off that ink from the nozzle outlet surface 31 which the doctor blade 29 has not picked up.

After the cleaning head has been drawn past the nozzle plate 49, corresponding to the diagrammatically represented movement path 69 (note FIG. 5), the cleaning module 12 can be withdrawn from the ink jet printer 3 again, and the printing operation with the latter can be resumed again after the print head 4 has been lowered into the printing position 4.1 thereof (note FIG. 1).

I claim:

1. A device for cleaning a nozzle outlet surface on a print head of an ink jet printer by a cleaning head formed of a doctor blade and connected to a vacuum generator, the cleaning head comprising at least one additional doctor blade and an evacuation chamber formed between the doctor blades in the cleaning head and being subjectible to suction air and vacuum, respectively, applicable by the vacuum generator, the doctor blades being disposed as seals for sealing off the evacuation chamber between the cleaning head and the nozzle outlet surface.

2. The device according to claim 1, including a motor for moving the cleaning head parallel to the nozzle outlet surface via a first mechanism and toward and away from the nozzle outlet surface via a second mechanism.

3. The device according to claim 2, wherein said first mechanism is a flexible drive mechanism.

4. The device according to claim 2, wherein said second mechanism is a cam control.

5. The device according to claim 1, wherein the cleaning head is disposed underneath the nozzle outlet surface.

6. The device according to claim 1, wherein the cleaning head is connected to the print head via an ink circuit for again feeding drawn-off ink to the print head.

7. The device according to claim 1, wherein the cleaning head has at least three doctor blades.

8. An ink jet printer having a device for cleaning a nozzle outlet surface on a print head of the ink jet printer by a cleaning head formed of a doctor blade and connected to a vacuum generator, the cleaning head comprising at least one additional doctor blade and an evacuation chamber formed between the doctor blades in the cleaning head and being sibjectible to suction air and vacuum, respectively, applicable by the vacuum generator, the doctor blades being disposed as seals for sealing off the evacuation chamber between the cleaning head and the nozzle outlet surface.

9. An ink jet printer according to claim 8, comprising a printing module and a cleaning module, said modules being of compatible construction so that the cleaning module is combinable with the printing module when appropriate.

10. An offset printing machine integrated with the ink jet printer according to claim 8.

11. An offset printing machine coupled for in-line operation with an ink jet printer according to claim 8.

12. A rotary printing machine integrated with the ink jet printer according to claim 8.

13. A rotary printing machine coupled for in-line operation with an ink jet printer according to claim 8.

* * * * *